US006489256B1

(12) United States Patent
Kent et al.

(10) Patent No.: US 6,489,256 B1
(45) Date of Patent: Dec. 3, 2002

(54) FIRE ESCAPE BLANKET AND OTHER MELAMINE RESIN CONTAINING COMPOSITIONS AND PRODUCTS WITH FIRE BLOCKING PROPERTIES

(76) Inventors: George M. Kent, 7 Hickory Creek Ct., Arden, NC (US) 28704; Karen L. Johnson, 11216 Megwood Dr., Charlotte, NC (US) 28277; Awni Sammakia, 336 Brookwood Dr., Elkin, NC (US) 28621

( * ) Notice: Subject to any disclaimer, the term of this patent is extended or adjusted under 35 U.S.C. 154(b) by 0 days.

(21) Appl. No.: 09/036,513

(22) Filed: Mar. 6, 1998

Related U.S. Application Data

(63) Continuation-in-part of application No. 08/938,525, filed on Sep. 26, 1997, now abandoned.

(51) Int. Cl.[7] ..... D03D 15/12; D04H 1/42; D04H 1/46; B32B 5/06; B32B 5/26

(52) U.S. Cl. ..... 442/302; 442/301; 442/381; 442/388; 442/402; 442/414; 442/415; 169/49; 169/54

(58) Field of Search ..... 442/402, 414, 442/415, 381, 388, 390, 301, 302; 428/359; 169/49, 54

(56) References Cited

U.S. PATENT DOCUMENTS

| | | | | | |
|---|---|---|---|---|---|
| 4,198,494 | A | * | 4/1980 | Burckel | 525/432 |
| 4,282,283 | A | * | 8/1981 | George et al. | 428/228 |
| 4,941,884 | A | * | 7/1990 | Green | 8/120 |
| 5,496,625 | A | * | 3/1996 | Lilani | 428/229 |
| 5,534,325 | A | * | 7/1996 | Jorder et al. | 428/102 |
| 5,560,990 | A | * | 10/1996 | Ilg et al. | 428/362 |
| 5,694,981 | A | | 12/1997 | Stanhope et al. | |
| 5,824,614 | A | * | 10/1998 | Gadoury | 442/415 |
| 5,849,648 | A | * | 12/1998 | Kent et al. | 442/414 |
| 5,853,880 | A | * | 12/1998 | Kent et al. | 428/365 |
| 5,888,652 | A | * | 3/1999 | Berbner et al. | 428/389 |
| 5,918,453 | A | * | 7/1999 | Kent et al. | 57/75 |
| 5,935,882 | A | * | 8/1999 | Fujita et al. | 442/247 |
| 6,102,128 | A | * | 8/2000 | Bridgeman | 169/49 |
| 6,287,686 | B1 | | 9/2001 | Huang et al. | 428/362 |
| 6,297,178 | B1 | | 10/2001 | Berbner | |
| 2001/0034897 | A1 | | 11/2001 | Belcher | 2/458 |

FOREIGN PATENT DOCUMENTS

| | | |
|---|---|---|
| DE | 196 17 634 A1 | 11/1997 |
| GB | 2 104 929 A | 3/1983 |
| WO | 2253194 | 11/1997 |

OTHER PUBLICATIONS

M.L. Joseph, Introductory Textile Science, 5th ed., (1986) pp. 130–134.*

* cited by examiner

*Primary Examiner*—Cheryl A. Juska
(74) *Attorney, Agent, or Firm*—Nixon & Vanderhye P.C.

(57) ABSTRACT

A blend of melamine resin fibers, aramid fibers and/or modacrylic fibers produces compositions and products having superior fire blocking characteristics, as well as superior strength, manufacturing and end-user comfort characteristics.

16 Claims, No Drawings

FIRE ESCAPE BLANKET AND OTHER MELAMINE RESIN CONTAINING COMPOSITIONS AND PRODUCTS WITH FIRE BLOCKING PROPERTIES

CROSS-REFERENCE TO RELATED APPLICATION

This application is a continuation-in-part application of copending U.S. application Ser. No. 08/938,525 filed on Sep. 26, 1997 now abandoned, the entire content of which is expressly incorporated hereinto by reference.

FIELD OF INVENTION

The present invention relates generally to the field of melamine resin containing compositions. In particular, the present invention is embodied in products that utilize critical blends of melamine resin fibers, aramid fibers and/or modacrylic fibers and that exhibit superior fire blocking characteristics, as well as superior strength, manufacturing and end-user comfort characteristics.

BACKGROUND AND SUMMARY OF THE INVENTION

In the event of a residential. workplace or vehicle fire, where humans are confronted with exposure to open flame and flash fire circumstances, there is no blanket-type product currently marketed that offers adequate fire blocking protection. The fireproof fabrics used in professional firefighter gear have historically been far too costly and bulky for use In a consumer safety product like a fire escape blanket (that is, a blanket that can be utilized by a person in a residential, industrial or vehicle setting to buck fire and its harmful effects from the skin of the person).

Professional firefighters' gear utilize materials such as PBI or Lenzing P-84 that are extremely expensive. Some industrial flame resistant fabrics use glass fiber, which is uncomfortable to the touch. For these reasons, i.e., cost and comfort, such materials do not lend themselves to user friendly applications such as fire escape blankets in residences, workplaces, vehicles and other environments. To date, fire blocking fiber technology has not made such a product viable from a consumer marketing standpoint. This is unfortunate considering the lives lost and injuries suffered due to first, second and third degree burns so common in residential, industrial and vehicle fires.

According to the present invention, economically viable fire blocking products for consumer safety, as well as professional safety, are made from melamine resin compositions. Broadly, the present invention is embodied in fabrics that include a critical combination of melamine resin fibers, aramid fibers and/or modacrylic fibers which result in products that are economically viable fire blocking products having superior strength, manufacturing and end-user comfort characteristics.

The products of the present invention were developed as a primary fire block for protection against extreme heat and open flame in any applicable emergency situation. These products have the potential of saving lives and preventing serious burn injuries in homes, nursing homes, hotels, vehicles, industrial and workplace environments and any other environment where there is a danger from fire or extremely high surface temperatures.

These and other aspects and advantages of the present invention will become more clear after careful consideration is given to the following detailed description of the preferred exemplary embodiments.

DETAILED DESCRIPTION OF THE INVENTION

The term "fibers" as used herein is meant to refer to staple fibers of varying lengths.

The fiber blend compositions of the present invention comprise a melamine resin fiber and effective amounts of an aramid fiber and/or a modacrylic fiber. In general, the fiber blend comprises between about 15 and about 80 parts by weight of melamine resin fibers, up to about 80 parts by weight of aramid fibers, and up to about 80 parts by weight of modacrylic fibers. A preferred embodiment of the present invention consists of a fiber blend wherein the melamine resin fibers are present in an amount between about 20 and about 50 parts by weight, the aramid fibers are present in an amount between about 20 and about 50 parts by weight, and the modacrylic fibers are present in an amount between about 20 and about 50 parts by weight. Another preferred embodiment of the present invention consists of a fiber blend wherein the melamine resin fibers are present in an amount between about 30 and about 36 parts by weight, the aramid fibers are present in an amount between about 30 and about 36 parts by weight, and the modacrylic fibers are present in an amount between about 30 and about 36 parts by weight. A further preferred embodiment of the present invention consists of a fiber blend wherein the melamine resin fibers are present in an amount of about 33⅓ parts by weight, the aramid fibers are present in an amount of about 33⅓ parts by weight, and the modacrylic fibers are present in an amount of about 33⅓ parts by weight.

The fire and flame resistant fabrics of the present invention most preferably have a weight of from about 4.0 to about 20.0 ounces per square yard, advantageously from about 6.0 to about 10.0 ounces per square yard. Fabric weights of from about 7.0 to about 8.0 ounces per square yard are especially useful. Usually, the fire and flame resistant fabrics of this invention will have a thickness of from about 3/16 inch to about ½ inch.

The fibers comprising the fire and flame resistant fabric, that is the melamine resin fibers, aramid fibers and modacrylic fibers, are generally uniformly distributed throughout the fabric. At least one additional layer may be attached to the fabric. For example, the additional layer attached to the fabric may comprise one or more woven fabric layers, non-woven fabric layers knitted fabric layers, films and combinations thereof. For example, the additional layer may be a fiberglass fabric attached to a layer of needle-punched non-woven fire and flame resistant fabric comprised of a blend of melamine resin fibers, aramid fibers and modacrylic fibers.

According to the present invention, the fiber blend may be utilized so as to yield a composition having superior fire blocking characteristics, as well as superior strength, manufacturing and end-user comfort characteristics. These compositions can be used in blankets (referred to herein as "fire escape blankets"), wall liner materials (for example, wall paper or wall curtains) in nursing homes and other buildings, thermal liner products, welding curtains used in industrial applications and other applications where fire and/or high temperatures are to be blocked.

The melamine resin fibers that may be employed in the present invention are those produced from highly concentrated solutions of melamine-formaldehyde precondensabon products, after addition of an acidic curing agent, by rotospinning, drawing out, extrusion or fibrillation. The fibers obtained are generally predried with or without stretching, and the melamine resin is usually cured at from 120° C. to 250° C. The fibers are usually from about 0.3 to about 8 denier and from about 0.5 to about 8 inches in length. Particularly, thermally stable fibers are obtained when up to about 30 mole percent, in particular, from about 2 to about 20 mole percent, of the melamine in the melamine resin is replaced by a hydroxyalkylmelamine. Such fibers have a sustained use temperature of up to 200° C. preferably up to 220° C. In addition, minor amounts of melamine can be replaced by substituted melamines, urea or phenol. A particularly preferred melamine resin fiber for use in the present invention Is commercially available from BASF Corporation under the tradename BASOFIL®.

The aramid fibers that may be employed in the present invention are those produced by spinning solutions of polycondensation products of isophthalic or terephthalic acid with para- or meta-phenylenediamine in solvents such as, for example, a mixture of N-vinylpyrrolidone and hexamethylphosphoriamide. The resulting continuous fibers are then cut into staple fibers, whose denier is usually from about 0.3 to about 8. Preferred aramid fibers are those based on an isomeric poly-(p-phyleneterephthalamide). A particularly preferred aramid fiber for use in the present invention is commercially available from E. I. du Pont de Nemours & Company under the tradename KEVLAR®, or from Akzo Nobel under the tradename TWARON®.

As used in this application, the term "modacrylic fiber" is generally meant to refer to a fiber in which the fiber forming substance is any long chain synthetic polymer composed of less than about 85% but at least about 35% by weight of acrylonitrile units [—$CH_2$—CH(CN)—]. Suitable modacrylic fibers that may be employed in the present invention include, but are not limited to, modacrylic fibers produced by Kanebo, Ltd (Tokyo, Japan), self-extinguishing modacrylic fibers from Solutia (Atlanta, Ga.) and INIDEX® fibers produced by Courtaulds Fibers Ltd. (U.K.). Particularly preferred modacrylic fibers for use in the present invention are commercially available from Kaneka Corporation under the tradename KANECARON®.

The melamine resin fibers, aramid fibers and modacrylic fibers used in the present invention are typically intermixed in a conventional fiber blending apparatus. The starting materials are generally staple fibers of a usual length from about 1 inch to about 6 inches. Customary additives such as, for example, fillers, dyes, pigments, metal powders and/or delusterants may also be added with the fibers. The starting materials are typically fed via a conveying means into a flat card and premixed therein. The intermixing is then generally completed in a worker and stripper card. The wadding, obtained is then typically further processed into yams or webs, for, which the processes common in the textile industry can be used. These yarns, webs or fabrics can then be further processed into various textile or non-textile structures, depending on the field of application.

The fiber blends of the present invention may also be dyed using conventional methods and apparatus, as will be apparent to those of ordinary skill in the art. For example, the dye process may utilize a continuous pad/steamer, wherein the fiber blends, in fabric form, are dipped in an open width of fabric. The fabric then goes through a steamer at about 120° F. for about a twelve (12) minute dwell time. Subsequently, the fabric goes through a rinse. The pH is about 4, and is controlled by acetic acid.

The fiber blends of the present invention can be processed as yarn into fabrics such as, for example, for fire escape blankets, having superior fire blocking characteristics and improved economics when compared with other fabrics made of the individual fiber components alone.

To produce fabric from the fiber blends of the present invention, preferably with an aramid fiber content of from about 20 to about 50 percent by weight, the wadding obtained in the worker and stripper carding process can be cross-lapped and needled. The web obtained can be used, for example, for manufacturing fire blocking products.

In accordance with the present invention, needled nonwoven fabric can be cut to appropriate dimensions and packaged as blankets, or the edges may be hemmed if desired.

A further understanding of this invention is available from the following non-limiting examples thereof.

EXAMPLES

In accordance with a preferred embodiment of the present invention, equal parts of melamine resin fibers (BASOFIL®), para-aramid fibers (KEVLAR®), and modacrylic fibers (KANECARON®) were opened and blended together In a textile staple fiber processing line. The resulting fiber blend contained melamine resin fibers in an amount of about 33⅓ parts by weight, aramid fibers in an amount of about 33⅓ parts by weight, and modacrylic fibers in an amount of about 33⅓ parts by weight.

The fibers were transferred to a textile card where the fibers were further blended and oriented into a batt or wadding. The batt or wadding was then cross-lapped to build the weight to the desired level and to further blend the mix. The cross-lapped batt or wadding was then fed to a needle loom, which entangled the fibers creating a nonwoven fabric of sufficient integrity to be used as a blanket. The final weight was about 6 ounces per square yard.

The resulting nonwoven fabric was made into four blankets for testing on a thermal manikin. All tests (referred to hereinafter as the Thermal Manikin Test and described in copending and related U.S. application Ser. No. 08/938,525, now abandoned, the entire content of which has already been expressly incorporated herein by reference) were conducted with a heat flux of 2 cal/sq.cm-sec. The duration of each exposure was four seconds.

Each of the four test blankets was tested individually by wrapping each blanket around the manikin's torso one and half times. The wrapped manikin was then exposed to controlled flames for 4 seconds. Heat sensors measured temperature data, which was processed by a computer. The computer controlled the test procedure, acquired data from the instrumented manikin, calculated the incident heat flux and predicted burn injury, and produced a report of each test, the results of which are set forth in Table 1.

TABLE 1

Thermal Manikin Test Results

| Specimen | Weight (kg) | Exposure Time (sec) | Predicted Burn Injury (%) 2nd | 3rd | Total |
|---|---|---|---|---|---|
| 1 | 0.79 | 4 | 25 | 13 | 38 |
| 2 | 0.80 | 4 | 34 | 8 | 42 |
| 3 | 0.79 | 4 | 47 | 9 | 56 |
| 4 | 0.79 | 4 | 39 | 11 | 50 |
| Average: | 0.79 | 4 | 36 | 10 | 46 |

For comparison, Nomex IIIA Industrial Coveralls were tested in the same fashion as above and produced the test results in Table 2 below, which are the average of three Thermal Manikin Tests on Nomex IIIA Industrial Coveralls.

TABLE 2

| Thermal Manikin Test Results | | | | |
|---|---|---|---|---|
| | Exposure | Predicted Burn Injury (%) | | |
| Item | Time (sec) | 2nd | 3rd | Total |
| Nomex IIIA Industrial Coveralls | 4 | 38 | 26 | 64 |

As demonstrated by the above test results, the present invention exhibits unexpectedly superior fire blocking abilities (e.g., burn protection). When exposed to a heat flux of 2 cal/sq.cm-sec, the fabrics of the present invention provided the manikin with protection with a predicted second degree burn level of as low as about 25% (25% of the covered surface area of the manikin would suffer second degree burns) and a predicted third degree burn level of about 13% (13% of the covered surface area of the manikin would suffer third degree burns). The unexpected nature of the fire blocking characteristics of the present invention are demonstrated by the higher test results for the Nomex IIIA Industrial Coveralls.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fire blanket comprising a fire and flame resistant fabric comprising melamine resin fibers, aramid fibers, and modacrylic fibers.

2. The fire blanket of claim 1, wherein the fabric is a woven or non-woven fabric.

3. The fire blanket of claim 2, wherein the fabric is a needle-punched non-woven fabric.

4. The fire blanket of claim 3, wherein the fabric comprises from about 15 to about 80 parts by weight melamine resin fibers, from up to about 80 parts by weight aramid fibers, and from up to about 80 parts by weight modacrylic fibers.

5. The fire blanket of claim 4, wherein the fabric comprises from about 20 to about 50 parts by weight melamine resin fibers, from about 20 to about 50 parts by weight aramid fibers, and from about 20 to about 50 parts by weight modacrylic fibers.

6. The fire blanket of claim 5, wherein the fabric comprises about 33⅓ parts by weight melamine resin fibers, about 33⅓ parts by weight aramid fibers, and about 33⅓ parts by weight modacrylic fibers.

7. The fire blanket of claim 1, wherein the fabric has a weight of from about 4.0 to about 20.0 ounces per square yard.

8. The fire blanket of claim 7, wherein the fabric has a weight of from about 6.0 to about 10.0 ounces per square yard.

9. The fire blanket of claim 8, wherein the fabric has a weight of from about 7.0 to about 8.0 ounces per square yard.

10. The fire blanket of claim 1, wherein the fabric has a fabric thickness of from about 3/16 inch to about ½ inch.

11. The fire blanket of claim 1, wherein the melamine resin fibers, aramid fibers, and modacrylic fibers are generally uniformly distributed throughout the fabric.

12. The fire blanket of claim 1, further comprising at least one additional layer attached to the fabric.

13. The fire blanket of claim 12, wherein the at least one additional layer comprises one or more woven fabric layers, non-woven fabric layer, knitted fabric layers, films, and combinations thereof.

14. A fire and flame resistant laminate comprising two or more layers, wherein at least one layer comprises a fabric comprising melamine resin fibers, aramid fibers, and modacrylic fibers.

15. The fire and flame resistant laminate of claim 14, wherein the fabric is a needle-punched non-woven fabric comprising about 33⅓ parts by weight melamine resin fibers, about 33⅓ parts by weight aramid fibers, and about 33⅓ parts by weight modacrylic fibers.

16. The fire and flame resistant laminate of claim 15, further comprising a layer of fiberglass fabric attached to the needle-punched non-woven fabric.

* * * * *